United States Patent [19]

Urban et al.

[11] 4,438,816

[45] Mar. 27, 1984

[54] PROCESS FOR RECOVERY OF HYDROCARBONS FROM OIL SHALE

[75] Inventors: Peter Urban, Northbrook; Russell W. Johnson, Villa Park; Lee Hilfman, Mt. Prospect, all of Ill.

[73] Assignee: UOP Inc., Des Plaines, Ill.

[21] Appl. No.: 378,024

[22] Filed: May 13, 1982

[51] Int. Cl.[3] ..... C10G 1/04; E21B 43/24

[52] U.S. Cl. ..... 166/303; 166/272; 208/11 LE

[58] Field of Search ..... 208/11 LE, 11 R; 166/272, 303, 273, 274

[56] References Cited

U.S. PATENT DOCUMENTS

| | | | |
|---|---|---|---|
| 3,241,611 | 3/1966 | Dougan | 166/245 |
| 3,358,756 | 12/1967 | Vogel | 166/272 X |
| 3,474,863 | 10/1969 | Deans et al. | 166/266 |
| 3,515,213 | 6/1970 | Prats | 166/252 |
| 3,528,501 | 9/1970 | Parker | 166/272 X |
| 3,598,182 | 8/1971 | Justheim | 166/272 X |
| 3,695,354 | 10/1972 | Dilgren et al. | 208/11 LE X |
| 4,158,638 | 6/1979 | Tsai | 208/11 LE |
| 4,390,411 | 6/1983 | Seinta et al. | 208/11 R X |

FOREIGN PATENT DOCUMENTS

| | | | |
|---|---|---|---|
| 493447 | 10/1938 | United Kingdom | 208/11 LE |

OTHER PUBLICATIONS

"Nonretorting Method Recovers Shale Organics," *Chemical and Engineering News,* (Sep. 14, 1981), 54.

*Primary Examiner*—Stephen J. Novosad

*Attorney, Agent, or Firm*—James R. Hoatson, Jr.; John G. Cutts, Jr.; William H. Page II

[57] ABSTRACT

A process for the recovery of hydrocarbonaceous oil from oil shale is disclosed. The process comprises: (a) heating the shale in the presence of a non-combustion supporting, non oil-miscible gas at subcritical conditions of said gas and at a temperature from about 650° F. to about 825° F. to produce a solvent extractable material and to liberate at least a first portion of the hydrocarbon contained therein; and (b) contacting the resulting solvent extractable material with a normally-liquid solvent at subcritical, reflux conditions of said solvent to liberate at least a second portion of the hydrocarbon contained in said solvent extractable material.

16 Claims, No Drawings

PROCESS FOR RECOVERY OF HYDROCARBONS FROM OIL SHALE

FIELD OF THE INVENTION

The field of art to which this invention pertains is the recovery of hydrocarbonaceous oil from oil shale. It relates to the processing of oil shale in a manner which allows the recovery of a high percentage of the hydrocarbonaceous oil which is contained therein. The present invention will be most useful in a process for recovering a high percentage of the hydrocarbonaceous oil contained in oil shale.

Shale oil is not a naturally occurring product, but is formed by the pyrolysis or distillation of organic material, commonly called kerogen, formed in certain shale-like rock. The organic material has limited solubility in ordinary solvents and therefore cannot economically be recovered by simple direct extraction. Upon strong heating, the organic material decomposes into a gas and hydrocarbonaceous liquid with relatively low recovery of hydrocarbons. Residual carbon typically remains on the retorted shale. An analytical technique which is referred to as the Fisher assay by those skilled in oil shale conversion is essentially a high temperature pyrolysis of an oil shale sample at a temperature greater than 900° F. and is used to measure the recoverable organic material which is derived from the shale under the test conditions. Generally, the Fisher assay is capable of measuring only about 60% of the total available organic material in shale.

In its basic aspects, the retorting of shale and other similar hydrocarbon-containing solids is a simple operation. The major step involves the heating of the solid material to high temperature and the recovery of the vapor evolved. However, for a commercially feasible process, it is necessary to consider and properly choose one of the many possible methods of physically moving the solids through a vessel in which the retorting is to be carried out as well as the many other variances and operating parameters, all of which are interrelated. The choice of a particular method of moving the solids through the vessel must include a consideration of mechanical aspects as well as the chemistry and the processes involved. Further, it is necessary to consider many possible sources of heat that may be used for the pyrolysis or destructive distillation.

In order to achieve a retorting process that is economically attractive and one which produces the maximum amount of high-quality shale oil, the various operating parameters must be controlled so that the overall process is economical, continuous and highly reliable. Any equipment used in the process must permit a high throughput of material since enormous quantities of shale must be processed for a relatively small recovery of shale oil. Process equipment for shale must have a high thermal efficiency and all mechanical devices should be as simple as possible. Furthermore, if retorting is successful in approaching the organic recovery of Fisher assay analysis, up to about 40% of the available organic material remains associated with the spent shale residue.

Since solvent extraction of oil shale has not been a viable process and the continuous efforts for the development of oil shale retorting have not provided a single large scale commercial plant, the need for an improved process for recovering a high percentage of hydrocarbonaceous oil from oil shale is apparent.

DESCRIPTION OF THE PRIOR ART

In an effort to provide an economically commercial process, literally hundreds of retorting processes have been proposed, each of which offers a somewhat different choice and/or combination of the many possible operating conditions and apparatus.

One problem with many prior art processes is that the quality of the shale oil obtained is relatively low. In many prior art processes long residence time at high temperature results in many secondary and undesirable side reactions, such as cracking, which may increase the production of normally gaseous products and decrease the yield and quality of the normally liquid product.

Another problem with many prior art processes is that a portion of the shale oil is combusted to produce heat for the process, which also leads to a decrease in the yield of condensable hydrocarbons. Thus, in any process designed to produce the maximum yield of high-quality condensable hydrocarbons, it is preferred that the retorting takes place in the absence of molecular oxygen and that the volatilized hydrocarbons are quickly removed from the retorting vessel in order to minimize deleterious side reactions, such as cracking or polymerization.

The quality and yield of shale oil produced is greatly dependent upon how the retorting process is operated. For example, the raw shale can be heated rapidly or slowly and the shale can be finely divided or vary widely in size. These and other factors greatly influence the quality and quantity of the shale oil produced and the overall thermal efficiency of the process. In essentially all processes for the retorting of shale, the shale is first crushed to reduce the size and time necessary for retorting. Crushing is very expensive and large amounts of energy are required in breaking up the shale and separating the shale into various size ranges. During the crushing and mining of the shale, it is difficult to obtain uniformly sized pieces and/or to separate the crushed shale into various sizes. Also, it is extremely expensive to crush all of the shale to a very small uniform size. Furthermore, many prior art processes cannot tolerate excessive amounts of shale below about ½ inch, while in other prior art processes all of the shale to be processed must be very small, less than 100 mesh, as is required in entrained-bed processes or of relatively uniform small size as is required in fluidized-bed processes.

Another problem with many prior art processes, particularly with countercurrent flow processes, is that after the shale oil has been vaporized, it then comes in contact with countercurrent flowing solids which are at a much cooler temperature, which leads to condensation of a portion of the shale oil and readsorption of a portion of the vaporized shale oil into the downflowing shale. This condensation and readsorption leads to coking, cracking, and polymerization reactions, all of which are detrimental in regard to producing the maximum yield of high quality, condensable hydrocarbon.

In general, it is known that a temperature on the order of over 900° F. is necessary to convert the organic material of the rock to oil. As the temperature of pyrolysis increases, however, considerable changes may occur in the shale oil. For economic considerations, however, it would appear to be desirable to maintain the pyrolysis temperature as low as necessary to produce oil and to convert substantially all of the organic material to oil or gas.

The pyrolysis of the organic material in oil shale, in its fundamental aspects, appears to be a relatively simple operation. The process involves heating the shale to a proper temperature and recovering the products which are emitted from the shale. In practical application, however, this apparently simple operation has not been achieved in a large scale commercial application, even though dozens of types of processes and literally hundreds of types of equipment have been devised for the oil shale retorting. In one general method, oil shale is mined, reduced to relatively small particles, fed to a retort where it is heated to a temperature necessary to produce the required pyrolysis. The pyrolysis, generally, produces a mist of liquid droplets and various gases which are withdrawn from the particulate shale. The retorted shale is then subsequently discarded.

More recently, workers at the Department of Energy's Laramie Energy Technology Center in Laramie, Wyoming have disclosed a process for the recovery of hydrocarbonaceous oil from oil shale wherein oil shale is first contacted with a supercritical fluid comprising water and methanol and subsequently the resulting shale is refluxed with a benzene/methanol mixture to extract the organic material. Further details of this work are contained in a magazine article titled "Non-retorting Method Recovers Shale Organics," *Chemical and Engineering News,* (Sept. 14, 1981), 54.

The developers of the hereinabove described process believe that the water present in the first step behaves as a supercritical fluid. Although temperature and pressure parameters have not been definitively revealed in the hereinabove mentioned article, the critical temperature of water is approximately 705° F. and the vapor pressure of water at 705° F. is about 3200 psia. Therefore, in order to achieve a supercritical state for an aqueous system the temperature and pressure must exceed at least about 705° F. and 3200 psia, respectively. This proposed prior art process scheme suffers from the disadvantage of very high processing pressures which accompany the supercritical state of aqueous systems. Another serious disadvantage is that the water which is intimately contacted with the oil shale will undoubtedly become contaminated with arsenic which condition creates a potentially hazardous environmental problem.

In U.S. Pat. No. 3,241,611 (Dougan), petroleum products are recovered from oil shale by contacting shale with methane to exert a combined thermal and solvent action thereon for releasing the kerogen from areas of the oil shale with which it comes in contact and for permeabilizing such oil shale to open up normally inaccessible areas thereof to thermal decomposition of kerogen and withdrawing methane along with distillation vapors and gases intermingled therewith. This process is not capable of recovering the heavier hydrocarbonaceous components or the semi-organic components of the oil shale which are not readily solvated by methane, thereby, reducing the overall recovery of product.

Another U.S. Pat. No. 3,515,213 (Prats), claims a process for producing hydrocarbons from oil shale which comprises circulating an oil-miscible fluid containing hydrogen sulfide therein in contact with oil shale while heating and flowing the fluid at rates such that the temperature of the fluid is from about 10° F. greater than the natural temperature of the oil shale to about 600° F. until a significant proportion of the organic components of the heated oil shale are converted to oil-shale-derived fluidizable materials. This process limits the temperature conditions to less than about 600° F. which in turn, according to data presented in the drawing, requires several days or months to recover significant portions of the hydrocarbons contained in the oil shale.

In yet another U.S. Pat. No. 3,474,863 (Deans et al), a process is claimed for producing shale oil from oil shale which comprises circulating a fluid through fragmented oil shale while heating the fluid to at least approximately the critical temperature of a preselected normally liquid hydrocarbon solvent under the critical pressure for the solvent and circulating the preselected solvent through the oil shale at a temperature from approximately its critical temperature to about 900° F. while maintaining the solvent at substantially supercritical conditions during circulation. This process requires the maintenance of the solvent at supercritical conditions and with these high severity conditions for at least several months, the recovery of hydrocarbons from oil shale only begins to approach the Fischer Assay.

The present invention enables the recovery of a high percentage of hydrocarbonaceous oil from an oil shale without suffering the disadvantage of the prior art processes.

SUMMARY OF THE INVENTION

One embodiment of the present invention is a process for the recovery of hydrocarbons from oil shale containing hydrocarbons which comprises: (a) heating the shale in the presence of a non-combustion supporting, non oil-miscible gas at subcritical conditions of said gas and at a temperature from about 650° F. to about 825° F. to produce a solvent extractable material and to liberate at least a first portion of the hydrocarbon contained therein; and (b) contacting the resulting solvent extractable material with a normally-liquid solvent at subcritical, reflux conditions of the solvent to liberate at least a second portion of the hydrocarbon contained in said solvent extractable material.

Another embodiment of the present invention is a process for the in situ recovery of hydrocarbons from oil shale containing hydrocarbons which comprises: (a) heating the shale in the presence of a non-combustion supporting, non oil-miscible gas at subcritical conditions of the gas and at a temperature from about 650° F. to about 825° F. to produce a solvent extractable material and to liberate at least a first portion of the hydrocarbon contained therein; and (b) contacting the resultin9 solvent extractable material from step (a) with a normally-liquid solvent at subcritical, reflux conditions of the solvent including a temperature from about 100° F. to about 900° F. and a pressure from about atmospheric to about 2000 psig to liberate at least a second portion of the hydrocarbon contained in the solvent extractable material.

Yet another embodiment of the present invention is a process for the in situ recovery of hydrocarbons from oil shale containing hydrocarbons which comprises: (a) heating the oil shale in the presence of a non-combustion supporting, non oil-miscible gas at subcritical conditions of the gas and at a temperature from about 650° F. to about 825° F. to produce a friable material which exhibits a crush strength less than about 0.5 of the crush strength of the oil shale and to liberate at least a first portion of the hydrocarbon contained therein; and (b) contacting the resulting friable material from step (a) with a normally liquid solvent at subcritical reflux conditions of the solvent including a temperature from about 100° F. to about 900° F. and a pressure from about atmospheric to about 2000 psig and to liberate at least a second portion of the hydrocarbon contained in the friable material.

Other embodiments of the present invention encompass further details such as types of oil shale, preferred solvents, and operating conditions including preferred temperatures and pressures, all of which are hereinafter disclosed in the following discussion of each of these facets of the invention.

DETAILED DESCRIPTION OF THE INVENTION

The oil shales (hereinafter "shale") utilized in the process of the present invention are found in deposits occurring in many countries of the world. The shales of the Green River formation in Colorado, Utah and Wyoming are among the most significant and illustrate the many varied deposits in the United States. These lacustrine beds of the Green River formation are Eocene in age and occur in the Piceance Creek, Uinta, and Green River basins as well as several smaller basins. The Piceance Creek basin of Colorado covers about 1500 square miles, and the Green River and lesser basins in Wyoming cover about 9600 square miles. The thickest and richest beds are in the center of the Piceance Creek basin where they reach 2000 feet of 25 gallon per ton average material which lies under approximately 1000 feet of barren overburden. Oil shale occurs in at least twenty-eight states, including Idaho, Illinois, Indiana, Kansas, Michigan, Arksansas, Nevada, New York, New Mexico, Ohio, Oklahoma, Pennsylvania, Tennessee and Texas. However, these deposits seldom exceed 15 gallons per ton over thicknesses of 15 feet or more and are of less economic significance than those of the Green River formation. Although the present invention is generally suited for all types of oil shale, Green River (or Western) shale oil is a preferred oil shale. Shale is sedimentary rock with a relatively high organic content. The organic matter, or kerogen, of the shale is believed to exist between particles of inorganic matter, and some portion thereof may be directly or chemically bonded to mineral constituents. The inability of the usual organic solvents to remove kerogen from shale directly and the failure of usual ore-dressing techniques (sink-float) to result in appreciable enrichment in organic matter is believed to indicate that most of the keroqen is held to the inorganic matter of the shale by bonds stronger than mere physical adsorption.

We have discovered that when oil shale is heated to a temperature from about 650° F. to about 825° F. in the presence of a non-combustion, supporting non oil-miscible gas at subcritical conditions of the gas, the oil shale undergoes a transformation to a solvent extractable material which is significantly easier to comminute than the original shale and a portion of the hydrocarbonaceous oil from the shale is liberated. The term "solvent extractable" is meant to describe the condition of a shale-derived material which is susceptible to the loss or extraction of organic material from inorganic material by contact with an appropriate normally liquid solvent at subcritical, reflux conditions. Suitable normally liquid solvents and subcritical, reflux conditions are described hereinafter. This temperature treatment in the presence of the above mentioned gas of the shale not only produces a solvent extractable material but enables a solvent recovery of essentially all of the available hydrocarbonaceous fraction which is available in the shale. In order to avoid the disadvantages of supercritical conditions of the prior art, viz., U.S. Pat. No. 3,474,863, the heating step of the present invention is conducted at subcritical conditions and the solvent extraction step of the present invention is conducted at subcritical conditions. In accordance with the present invention the heat treatment step of the shale is conducted at a temperature from about 650° F. to about 825° F. to perform the first step of the instant process in a more timely manner in contrast to U.S. Pat. No. 3,515,213. The present invention utilizes a normally liquid solvent to ensure very high recovery of the hydrocarbonaceous components as well as the semi-organic components as distinguished from U.S. Pat. No. 3,241,611.

Broadly, the term "subcritical conditions" is used herein to define the condition of a component wherein at least the temperature or the pressure is less than the critical temperature or critical pressure of the component.

The heat treatment to the present invention not only produces a solvent extractable material but generally a material which is extremely friable. In accordance with the present invention the term "friable material" is meant to indicate that material which is easily crumbled or pulverized. Since the solvent extraction step itself is successful for most shales in further enhancing the friable characterisitics of the shale, the semi-organic fraction may be readily slurried in solvent and thereby recovered from the inorganic residue.

One of the advantages of the present invention is the reduced environmental pollution whereby the quantity of waste water is minimized while at the same time any water associated with the processing plant will contain significantly less quantities of undesirable contaminants than prior art processes. The actual process steps require no water which is additionally degraded in quality. Another advantage is that the recovered hydrocarbonaceous oil may be separated from solvent and further processed in a conventional and facile manner. When a typical Western oil shale is processed in accordance with the method of the present invention, a hydrocarbonaceous oil yield of about 15–18 percent can be expected as compared with a 12 percent yield expected from conventional retorting based on the weight of shale. This degree of recovery represents essentially total recovery of the organic material present in the shale. In addition to the abundant recovery of hydrocarbonaceous oil, the present process also yields a hydrocarbon containing gas rich in hydrogen which may be profitably employed.

In cases where the oil shale may be readily processed according to the present invention before the shale is completely removed from the mine, the invention offers the potential advantage of considerable energy saving by minimizing or eliminating the pulverization or comminution which is required in at least some of the prior art shale processes. In the event that in situ processing is conducted, the resulting friable shale material may then conveniently be transported via a slurry pipeline if so desired.

Since many of the prior art retorting processes required the shale to be subjected to temperatures of greater than about 900° F., another advantage enjoyed by the process of the present invention is that oil shale need only be heated to a temperature of less than about 900° F.

In accordance with the present invention, the oil shale may be processed in situ or removed from the mine and processed at a conventional plant site. One embodiment of the present invention involves the in situ production of hydrocarbonaceous products from shale, which is especially useful where a substantial overburden rakes strip mining expensive and unattractive. In this embodiment, a portion of the shale bed is mined mechanically by shale removal through a shaft to the ground surface or is repeatedly perforated by conventional drilling techniques to gain access to that portion of shale which is to be processed in situ. Sumps are formed at locations which will receive hydrocarbonaceous liquids and conduits extend into the sumps and terminate above ground level for recovery of the hydrocarbonaceous liquids. Large contiguous volumes of shale may be subjected to the process of the invention directly or may be converted to rubble by explosives. The rubble particles may be of any size but usually are from about 6 to 12 inches in diameter. The in situ shale may be heated by radio frequency waves, circulating hot gases, or any other convenient method. Alternatively, after in situ shale is treated at a temperature sufficient to produce a friable material, the solvent may be introduced and used to form a shale slurry which may then be pumped to the surface for further extraction, separation or processing as desired.

Another embodiment of the present invention involves the processing of oil shale in a conventional surface plant. In this embodiment, the oil shale is first crushed, ground or otherwise pulverized to a desired particle size suitable for the type of operation to be used. The process of the invention may be conducted with a fixed, moving or fluidized bed operation. For fixed bed operation, a size that will pass a six-inch screen mesh may be used, but smaller sizes may also be used. For moving bed operations, particles having an average diameter of one inch or less can typically be used, and for fluidized operations, the particles will be powder size and may have average diameters as low as 10 microns. Of course, it must be recognized that as the oil shale is reduced in size, some of the hereinabove described advantages of the present invention may not be fully enjoyed.

Regardless of whether the oil shale is processed in situ or not, in accordance with the present invention, the shale is preferably heated to a temperature in the range of from about 650° F. to about 825° F. and more preferably from about 650° F. to about 800° F. This heating is conducted in the presence of a non-combustion supporting, non oil-miscible gas to prevent any oxidation of shale and to minimize any deleterious conversion of the hydrocarbonaceous oil derived from the shale. This heating step is also conducted at subcritical conditions of the hereinbefore described gas. The elevated temperature in the presence of the gas promotes the conversion of shale to a more solvent extractable or friable material which is more readily conducive to the maximum recovery of the hydrocarbonaceous oil contained in the raw shale. Any gas which is non-combustion supporting and non oil-miscible may suitably be used during the heat treatment of shale. Suitable gases may be selected from ammonia, sulfur dioxide, mercaptan hydrocarbon, carbon monoxide, carbon dioxide, water, hydrogen, or mixtures thereof. Preferred gases include nitrogen and hydrogen sulfide. It is expected in certain cases, that a particular gas will produce better results than other gases.

The shale is maintained at temperature for a sufficient amount of time to produce a solvent extractable material and to liberate at least a portion of the hydrocarbon contained in the raw shale. In the case where the heating of the shale in accordance with the present invention produces both a solvent extractable and friable material, the maximum benefit and advantage is enjoyed. The word "friable" is meant to conform to the traditional definition, viz., easily crumbled or pulverized. When it is said that the raw shale is contacted at an elevated temperature in accordance with the present invention to produce a friable material, we mean that the original crush strength of the shale has been substantially reduced. A preferred degree of crush strength is when the crush strength of heated shale is less than about 0.5 of the crush strength of the raw shale. A friable material is preferably produced upon heating in accordance with the present invention for a period ranging from about 0.1 to about 10 hours depending on the temperature selected and the particular oil shale. Of course, the liberation of hydrocarbonaceous oil from the shale will be obvious to those skilled in the art.

Unlike the prior art, the contacting of the shale with the gas at elevated temperature need not be conducted at exceedingly high pressures and, in fact, must be conducted at conditions which are subcritical with respect to the gas selected. The only pressure required is to maintain a gas blanket on the shale. The process of the present invention is suitably conducted at a pressure from about atmospheric to about 2000 psig. Preferred pressures include a pressure from about atmospheric to about 500 psig while more preferred pressures include a pressure from about atmospheric to about 100 psig. The temperature required to heat treat the shale in the presence of the gas in accordance with the present invention is from about 650° F. to about 825° F.

After the oil shale has been treated in accordance with the present invention at the required temperature in the presence of gas, the resulting solvent extractable material or treated shale which is now susceptible to solvent extraction is contacted with a normally liquid solvent at subcritical, reflux conditions to liberate hydrocarbonaceous oil. Suitable solvents may be selected from those solvents which display the characteristic ability of being able to maintain the hydrocarbonaceous oil from shale in solution and which are normally liquid at atmospheric temperature and pressure. In accordance with the present invention, a suitable solvent may comprise aromatic hydrocarbons, such as benzene, xylene and toluene. A preferred solvent comprises toluene, benzene or mixture thereof. Benzene and toluene have boiling points of 176° F. and 232° F., respectively. Another preferred solvent comprises a hydrocarbon fraction recovered from coal, oil shale, tar sand or petroleum crude oil. These preferred hydrocarbon fractions may preferably be hydrotreated. The solvent extraction of the treated shale is conducted with a normally-liquid solvent at subcritical, reflux conditions of the solvent. In the laboratory, for instance, the solvent extraction may be performed in what is known as a Soxhlet extraction apparatus whereby the solvent is refluxed in contact with the treated shale. Regardless of the apparatus selected to perform the solvent extraction, the conditions for extraction are relatively mild. The temperature selected for the solvent extraction of course will depend on the solvent selected and the temperature utilized will be approximately the boiling point of the solvent. In general, the solvent extraction temperature preferably ranges from about 100° F. to about 900° F., more preferably from about 100° F. to about 600° F. The solvent extraction is conducted at a pressure which prevents the escape of the solvent and any hydrocarbonaceous product and which pressure is not critical to the operation of the present invention. Generally, the extraction is preferably conducted at a pressure from about atmospheric to about 2000 psig, more preferably from about atmospheric to about 500 psig. However, in any event, the solvent extraction conditions are subcritical with respect to the normally-liquid solvent selected. The degree and therefore the duration of solvent extraction will usually be dictated by economics and generally will not extend beyond the point where the expense of extraction equals the value of the hydrocarbons recovered. The admixture of the solvent and the hydrocarbonaceous shale oil may then be separated by conventional known techniques and the recovered hydrocarbonaceous shale oil may then be utilized or further processed in any desired manner.

The method of the present invention is further illustrated by the following examples and is not intended as an undue limitation on the generally broad scope of the invention as set out in the appended claims.

EXAMPLE I

A 700 gram sample of Green River Oil Shale from the Western United States containing approximately 21 weight percent organic material was comminuted to produce a powder having a mesh size of about −10 +20 U.S. sieve mesh. The comminuted oil shale was heated at 700° F. for about three hours at atmospheric pressure while being continuously purged with nitrogen at an hourly flow rate of about 4 volumes of nitrogen per volume of shale. This heating step produced 43 grams of retort oil, 14 grams of gas, 7.4 grams of water and a residual shale weighing 633.4 grams. The resulting residual oil shale was then extracted with toluene at a temperature of 231° F. and atmospheric pressure to yield a toluene extract oil weighing 71 grams. An additional 32 grams of semi-organic material was recovered from the shale after the toluene extraction. After these recovery steps, 509 grams of inorganic residual material remained. The total of gas, retort oil, toluene extract and semi-organic material which was recovered weighed 160 grams or 22.8 weight percent of the feed oil shale. The total weight of organic material recovered was 128 grams or 18.3 weight percent of the feed oil shale. The product analysis is presented in Table 1 and a summary of the results is presented in Table 2.

TABLE 1

PRODUCT ANALYSIS

| | Example I | Example II |
|---|---|---|
| Retort Oil | | |
| Distillation | | |
| IBP, °F. | 166 | 188 |
| 10% | 352 | 347 |
| 30% | 497 | 524 |
| 50% | 622 | 662 |
| 70% | 741 | 778 |
| 90% | 862 | 886 |
| EP | 1016 | 1017 |
| Arsenic, wt. ppm | 12 | 6.1 |
| Gas | | |
| Hydrogen, mole % | 47 | 56 |
| Methane, mole % | 20 | 15 |
| Carbon dioxide, mole % | 16 | 4 |
| Carbon monoxide, mole % | 4 | 5 |

TABLE 1-continued

PRODUCT ANALYSIS

| | Example I | Example II |
|---|---|---|
| Other light hydrocarbons, mole % | 11.2 | 8.2 |
| Nitrogen, mole % | 1.8 | 11.8 |
| Toluene Extract | | |
| Composition | | |
| Carbon, wt. % | 78.31 | 82.12 |
| Hydrogen, wt. % | 8.68 | 8.91 |
| Nitrogen, wt. % | 2.63 | — |
| Sulfur, wt. % | 0.68 | 1.81 |
| Carbon/hydrogen ratio | 9.02 | 9.2 |
| Arsenic, wt. ppm | 13 | 6 |

TABLE 2

SUMMARY OF RESULTS

| | Example I | Example II |
|---|---|---|
| Oil Shale, weight in grams | 700 | 700 |
| Operating Conditions | | |
| Temperature, °F. | 700 | 700 |
| Gas Purge | $N_2$ | $H_2S$ |
| Product Distribution | | |
| Retort Oil, g | 43 | 52 |
| Gas, g | 14 | 13.6 |
| Water, g | 7.4 | 9 |
| Toluene Extract Oil, g | 71 | 68 |
| Semi-Organic Material, g | 32 | 47 |
| Inorganic residual material, g | 509 | 526 |
| Organic material recovered, wt. % of shale | 18.3 | 19.1 |

EXAMPLE II

A 700 gram sample of Green River Oil Shale containing approximately 21 weight percent organic material was comminuted to produce a powder having a mesh size of about −10 +20 U.S. sieve mesh. The comminuted oil shale was heated at 700° F. for about three hours at atmospheric pressure while being continuously purged with hydrogen sulfide at an hourly flow rate of about 4 volumes of hydrogen sulfide per volume of shale. This heating step produced 52 grams of retort oil, 13.6 grams of gas, 9 grams of water and a residual shale weighing 624.8 grams. The resulting residual shale oil was then extracted with toluene at a temperature of 231° F. and atmospheric pressure to yield a toluene extract oil weighing 68 grams. An additional 47 grams of semi-organic material was recovered from the shale after the toluene extraction. After these recovery steps, 526 grams of inorganic residual material remained. The total of gas, retort oil, toluene extract and semi-organic material which was recovered weighed 180.6 grams or 25.8 weight percent of the feed oil shale. The total weight of organic material recovered was 133.6 grams or 19.1 weight percent of the feed oil shale. The product analysis is presented in Table 1 and a summary of the results is presented in Table 2.

EXAMPLE III

A representative sample of Green River Oil Shale was obtained and cut into three slabs with each being approximately 1.5 inches thick. The first slab or Sample I was used to prepare three cubes measuring approximately one inch on a side. These cubes were individually crush tested with the direction of loading parallel to the grain direction of the sample. The average crush strength for the three cubes prepared from Sample 1 was 9,300 psi.

The second slab or Sample 2 was subjected to a temperature of 700° F. for 3 hours at atmospheric pressure in a nitrogen atmosphere. Sample 2 was cooled and cut to prepare three cubes measuring approximately one inch on a side. These cubes were individually crush tested with the direction of loading parallel to the grain direction of the sample. The average crush strength for the three cubes prepared from Sample 2 was 850 psi.

The third slab or Sample 3 was also subjected to a temperature of 700° F. for 3 hours at atmospheric pressure in a nitrogen atmosphere. After Sample 3 was cooled, it was contacted with toluene at a temperature of 70° F. for approximately 3 hours. Then Sample 3 was removed from the toluene and dried at a temperature of 250° F. for approximately 2 hours. Sample 3 was then cut to prepare three cubes measuring approximately one inch on a side. These cubes were also individually crush tested with the direction of loading parallel to the grain direction of the sample. The average crush strength for the three cubes prepared from Sample 3 was 500 psi.

This example demonstrates the fact that raw oil shale is a formidable material which resists crushing and comminution in general. The conventional comminution of oil shale is therefore time-consuming, expensive and arduous. This example further illustrates that according to a preferred embodiment of the present invention, oil shale is readily converted to a friable material with the attendant advantages thereof. The resulting friable material is then in a condition, subsequent to solvent extraction, whereby this material may be further treated to recover the semi-organic fraction as hereinbefore described. For instance, a portion of Sample 3 which had not been crush tested was readily mulled in contact with toluene with a mortar and pestle for a relatively short period of time with mild pressure and the resulting slurry easily passed through a 60 U.S. mesh screen. This Example III also illustrates that when a western U.S. shale is heated, in accordance with the present invention, the crush strength of the shale is reduced to less than 0.5 of the original crush strength.

We claim:

1. A process for the recovery of hydrocarbons from oil shale containing said hydrocarbons which comprises:

(a) first heating said oil shale in the presence of a non-combustion supporting, non-oil miscible gas selected from the group consisting of nitrogen, hydrogen sulfide, ammonia, mercaptan, hydrocarbon, sulfur dioxide, carbon monoxide, carbon dioxide, water and mixtures thereof at subcritical conditions of said selected gas and at a temperature of from about 650° F. to about 825° F. to produce a solvent extractable material and to liberate at least a first portion of said hydrocarbon contained therein;

(b) recovering said solvent extractable material and said first hydrocarbon portion; and (c) then contacting said recovered solvent extractable material with a normally-liquid solvent at subcritical, reflux conditions of said solvent to liberate at least a a second portion of said hydrocarbon contained in said solvent extractable material.

2. The process of claim 1 wherein said solvent extractable material is friable.

3. The process of claim 1 wherein step (a) is conducted at conditions to produce a solvent extractable material having a crush strength which is less than about 0.5 of the crush strength of the raw oil shale.

4. The process of claim 1 wherein said solvent comprises an aromatic hydrocarbon.

5. The process of claim 1 wherein said solvent comprises toluene.

6. The process of claim 1 wherein said solvent comprises benzene.

7. The process of claim 1 wherein said solvent comprises toluene and benzene.

8. The process of claim 1 wherein said solvent comprises a hydrocarbon fraction recovered from coal, oil shale, tar sand or petroleum crude oil.

9. The process of claim 8 wherein said hydrocarbon fraction recovered from coal, oil shale, tar sand or petroleum crude oil is hydrotreated.

10. The process of claim 1 wherein said subcritical, reflux conditions include a pressure from about atmospheric to about 2000 psig and a temperature from about 100° F. to about 900° F.

11. The process of claim 1 wherein said subcritical, reflux conditions include a pressure from about atmospheric to about 500 psig and a temperature from about 100° F. to about 600° F.

12. The process of claim 1 wherein step (a) is maintained at said temperature from about 0.1 to about 10 hours.

13. The process of claim 1 wherein step (a) is conducted at a pressure from about atmospheric to about 500 psig.

14. The process of claim 1 wherein step (a) is conducted at a pressure from about atmospheric to about 100 psig.

15. A process for the in situ recovery of hydrocarbons from oil shale containing said hydrocarbons which comprises:

(a) first heating said oil shale in the presence of a non-combustion supporting, non-oil miscible gas selected from the group consisting of nitrogen, hydrogen sulfide, ammonia, mercaptan hydrocarbon, sulfur dioxide, carbon monoxide, carbon dioxide, water and mixtures thereof at subcritical conditions of said selected gas and at a temperature of from about 650° F. to about 825° F. to produce a solvent extractable material and to liberate at least a first portion of said hydrocarbons contained therein; and after said gas treatment;

(b) then contacting said resulting solvent extractable material of step (a) with a normally-liquid solvent at subcritical, reflux conditions of the solvent including a temperature of from about 100° F. to about 900° F. and a pressure of from about atmospheric to about 2000 psig to liberate at least a second portion of said hydrocarbon contained in said solvent extractable material.

16. A process for the in situ recovery of hydrocarbons from oil shale containing said hydrocarbons which comprises:

(a) first heating said oil shale in the presence of a non-combustion supporting, non-oil miscible gas selected from the group consisting of nitrogen, hydrogen sulfide, ammonia, mercaptan hydrocarbon, sulfur dioxide, carbon monoxide, carbon dioxide, water and mixtures thereof at subcritical conditions of said selected gas and at a temperature of from about 650° F. to about 825° F. to produce a friable material which exhibits a crush strength less than about 0.5 of the crush strength of said oil shale and to liberate at least a first portion of said hydrocarbon contained therein; and after said gas treatment;

(b) then contacting said resulting friable material from step (a) with a normally liquid solvent at subcritical, reflux conditions of said solvent including a temperature of from about 100° F. to about 900° F. and a pressure of from about atmospheric to about 2000 psig to liberate a second portion of said hydrocarbon contained in said friable material.

* * * * *